US006364511B1

(12) United States Patent
Cohen

(10) Patent No.: US 6,364,511 B1
(45) Date of Patent: Apr. 2, 2002

(54) UNIVERSAL ADAPTER BRACKET AND ORNAMENTAL TRIM ASSEMBLY USING SAME FOR IN-CEILING RECESSED LIGHT FIXTURES

(75) Inventor: Steve Cohen, Beverly Hills, CA (US)

(73) Assignee: AMP Plus, Inc., Vernon, CA (US)

( * ) Notice: Subject to any disclaimer, the term of this patent is extended or adjusted under 35 U.S.C. 154(b) by 0 days.

(21) Appl. No.: 09/539,347

(22) Filed: Mar. 31, 2000

(51) Int. Cl.[7] ..... F21V 11/00

(52) U.S. Cl. ..... 362/368; 362/148; 362/365; 362/404

(58) Field of Search ..... 362/368, 370, 362/371, 147, 150, 148, 404, 364, 365

(56) References Cited

U.S. PATENT DOCUMENTS 5,707,143 A * 1/1998 Hentz ..... 362/365
6,168,298 B1 * 1/2001 Hentz et al. ..... 362/365

* cited by examiner

*Primary Examiner*—Sandra O'Shea
*Assistant Examiner*—John Anthony Ward
(74) *Attorney, Agent, or Firm*—Beehler & Pavitt

(57) ABSTRACT

A universal adapter bracket for retaining a trim assembly In an in-celling recessed light fixture. The adapter bracket attaches to either a light baffle or trim ring of the trim assembly and in turn can receive a lamp socket retaining clip of either of two different types of an existing light fixture, allowing an existing light fixture to be updated by installation of a new trim assembly without concern for the type of lamp socket retaining dip in the existing fixture.

20 Claims, 6 Drawing Sheets

UNIVERSAL ADAPTER BRACKET AND ORNAMENTAL TRIM ASSEMBLY USING SAME FOR IN-CEILING RECESSED LIGHT FIXTURES

BACKGROUND OF THE INVENTION

1. Field of the Invention

This invention relates generally to the field of electric lighting fixtures and more particularly is directed to a universal adapter bracket which facilitates installation of ornamental trim in recessed in-ceiling lighting fixtures having a lamp socket supported on either of two commonly used types of mounting brackets. The invention includes a method for updating the ornamental appearance of existing light fixture installations using the novel universal adapter bracket.

2. State of the Prior Art

In-ceiling recessed lighting, also known as architectural lighting, is widely used and generally consists of light fixtures which are installed in a soffit space defined between a ceiling and a roof of a habitation or other architectural space. The recessed light fixtures include an outer housing in the form of a cylindrical can of sheet metal which is supported between wooden or metallic beams in the ceiling space. The outer housing is connected to an electrical power distribution box by wiring enclosed in metallic conduit. The outer housing is often supplied pre-assembled with a distribution box and electric conduit all mounted on a metal frame for installation as a unit into the ceiling space. The bottom of the outer housing is open and lines up with a hole in the ceiling. Once installed, this unit is hidden from view by the ceiling. The interior of the housing and the unfinished edge of the hole in the ceiling are concealed by ornamental trim which may include an optional light baffle designed to limit the field of illumination of the fixture and other trim elements such as ornamental rings or the like, attached to the bottom of the light baffle or integral therewith for concealing the edge of the hole in the ceiling. Many different trim designs are possible and available, of various materials, colors and finishes, limited only by the imagination of designers in the field. For example, light absorbent surfaces such as corrugated matte black interior baffle surfaces may control internal reflections in the lamp housing. Alternatively, a reflector of generally cylindrical or conically tapered shape with a polished internal surface may be substituted for the baffle in the light housing. One or more trim rings of larger diameter than the recessed housing supported at the bottom of the housing or the light baffle and flush with the ceiling surface may give a finished appearance to the installation by covering the edge of the hole in the ceiling. In economy versions of such light fixtures the light baffle may be omitted and only a trim ring provided, leaving exposed to view the interior surface of the lamp housing. For purposes of this disclosure the term baffle includes both a light absorbent baffle as well as a light reflector. The terms "trim assembly" is meant to include either or both of a trim ring and a light baffle.

A lamp socket is supported on the trim assembly, either at the top end of the baffle or attached directly to the trim ring if the fixture has no baffle, and facing the open bottom of the housing, so that a lamp bulb can be inserted into the housing and fitted into the socket through the opening in the ceiling. It is conventional in the industry to provide a mounting bracket which supports the lamp socket on the trim assembly, and also supports the trim assembly to the housing. The lamp socket is seated in a socket opening in the mounting bracket and is held in place by a smaller lamp socket spring clip riveted to the top of the socket. The spring clip engages and interlocks with the larger mounting bracket. The mounting bracket in turn attaches to the outer housing of the recessed light fixture and so serves the dual purpose of supporting the lamp socket to the trim assembly (and lamp bulb) as well as supporting the ornamental trim assembly to the lamp housing.

The lamp socket spring clip is generally shaped as a inverted U. The top of the lamp socket is riveted to the horizontal midportion of the spring clip with two arms of the spring clip extending downwardly along either side of the lamp socket. This lamp socket assembly is secured to the mounting bracket by inserting the free ends of the two arms of the spring clip into corresponding cut-outs or openings defined in the mounting bracket. These cut-outs and openings are sized, shaped and positioned so that the arms of the retaining clip must be squeezed together to bring the arms into engagement with the mounting bracket and, once so engaged and released, the clip arms remain under spring tension to hold the lamp socket in place on the mounting bracket.

The subassembly consisting of the lamp socket, lamp socket spring clip, mounting bracket, light baffle if any, and trim ring, is inserted upwardly through the open bottom of the recessed outer housing of the in-ceiling fixture and held in place by conventional spring wires which interconnect the mounting bracket and the outer housing.

Once an in-ceiling fixture is installed it is costly to remove and replace. For this reason, it is common practice to update the appearance of installed fixtures by merely replacing the ornamental elements such as the light baffles and/or the trim ring, and thereby effectively achieve the appearance of a new fixture at modest cost. From an end user's point of view it is therefore desirable that the trim assemblies of different manufacturers of recessed light fixtures be interchangeable so as to provide a wide selection of designs and features. To a large extent this is already the case because the housings of recessed fixtures are made in a number of standard diameters, and standard methods are used for mounting the trim assembly in the fixture housings.

However, in an effort to prevent the use of competing trim products, some manufacturers have adopted non-standard lamp socket spring clips for their lamp sockets which do not mate with the mounting brackets on trim assemblies of competing manufacturers. This artifice effectively restricts the choice of trim products to compatible product lines, forcing less than satisfactory choices in some cases, preventing the upgrading of existing installations in other cases, and forcing excessive expenditures in still other cases.

A need exists for a simple solution which will enable easy and low cost retrofitting of ornamental trim assemblies in existing in-ceiling light fixture installations without concern for the type of lamp socket spring clip found in the existing installation.

SUMMARY OF THE INVENTION

Addressing the aforementioned need the present invention provides a universal adapter bracket which replaces the conventional mounting bracket previously used for supporting the lamp socket in the trim assembly of in-ceiling recessed light fixtures. The novel adapter bracket is attached as by riveting to the trim assembly, either to the light baffle or directly to a trim ring. The adapter bracket has first and second retaining portions respectively engageable to a retaining clip of a first type or a second type for securing a lamp socket to the adapter bracket.

In a presently preferred form of the invention the adapter bracket has a midportion supported between two arms, each of the arms having a free end engageable to the trim assembly. A socket hole is provided in the midportion for inserting a lamp socket through the adapter bracket. The first and second retaining portions of the adapter bracket are preferably defined in the midportion. For example, the first retaining portions may be defined by two end cuts of a socket hole, each end cut adapted to receive one end of a spring clip of the first type, the end cuts being on longitudinally opposite sides of the socket hole along a first imaginary diameter line connecting the two arms of the adapter bracket. The second retaining portions of the bracket may be defined by two openings on transversely opposite sides of the socket hole along a second imaginary diameter line transverse to the first imaginary diameter line. The retaining portions include edge portions defined by the cut-outs and the openings, shaped and sized so as to receive and hold portions of the spring clips when the free ends of the spring clip arms are squeezed together and inserted into the corresponding cut-outs and openings. The retaining portions of the adapter bracket are spaced apart such that the free ends of the spring clips remain under spring tension thereby keeping the spring clips in retentive engagement with the adapter bracket. The retaining portions are arranged so that only one spring clip can be engaged to the bracket and an election between the two sets of retaining portions must be made according to the type of spring clip to be attached to the bracket.

That is, the first retaining portions includes spring clip retaining edges spaced apart by a first distance on the adapter bracket, and the second retaining portions include spring clip retaining edges spaced apart on the adapter bracket by a second distance substantially different from the first distance, such that lamp socket spring clips of different sizes may be engaged to the adapter bracket in one or the other of the first and second retaining portions.

More specifically, a first set of retaining portions is defined by a pair of cut-outs provided on diametrically opposed sides of the socket hole for accepting one type of retaining clip in a first diametric orientation across the socket opening. A second set of retaining portions is defined by a pair of openings provided on diametrically opposed sides of the socket hole for accepting another type of retaining clip in a second diametric orientation transverse to the first diametric orientation.

Consequently, a retaining clip of either type may be assembled and retained on the adapter bracket, the assembled positions of the different type clips being transverse to each other on the bracket. This in turn permits a trim assembly equipped with the novel adapter bracket of this invention to be installed, i.e. retrofitted, into an existing recessed lighting fixture installation without concern for which of the two types of lamp socket spring clip is found in the existing fixture.

In the presently preferred form of the invention the midportion of the adapter bracket includes a central portion which extends between and interconnects the two arms of the adapter bracket, and two side walls generally transverse to the central portion. For example, the adapter bracket may be a one-piece sheet metal stamping and the side walls may be each joined to the central portion along a corresponding bend line of the sheet metal. The first retaining portions of the bracket are defined in the aforementioned central portion while the second retaining portions are defined partly in the central portion and partly in the side walls.

These and other features, advantages and improvements of the present invention will be better understood by reference to the following detailed description of the preferred embodiment and the accompanying drawings.

DETAILED DESCRIPTION OF THE PREFERRED EMBODIMENT

Figure 1:
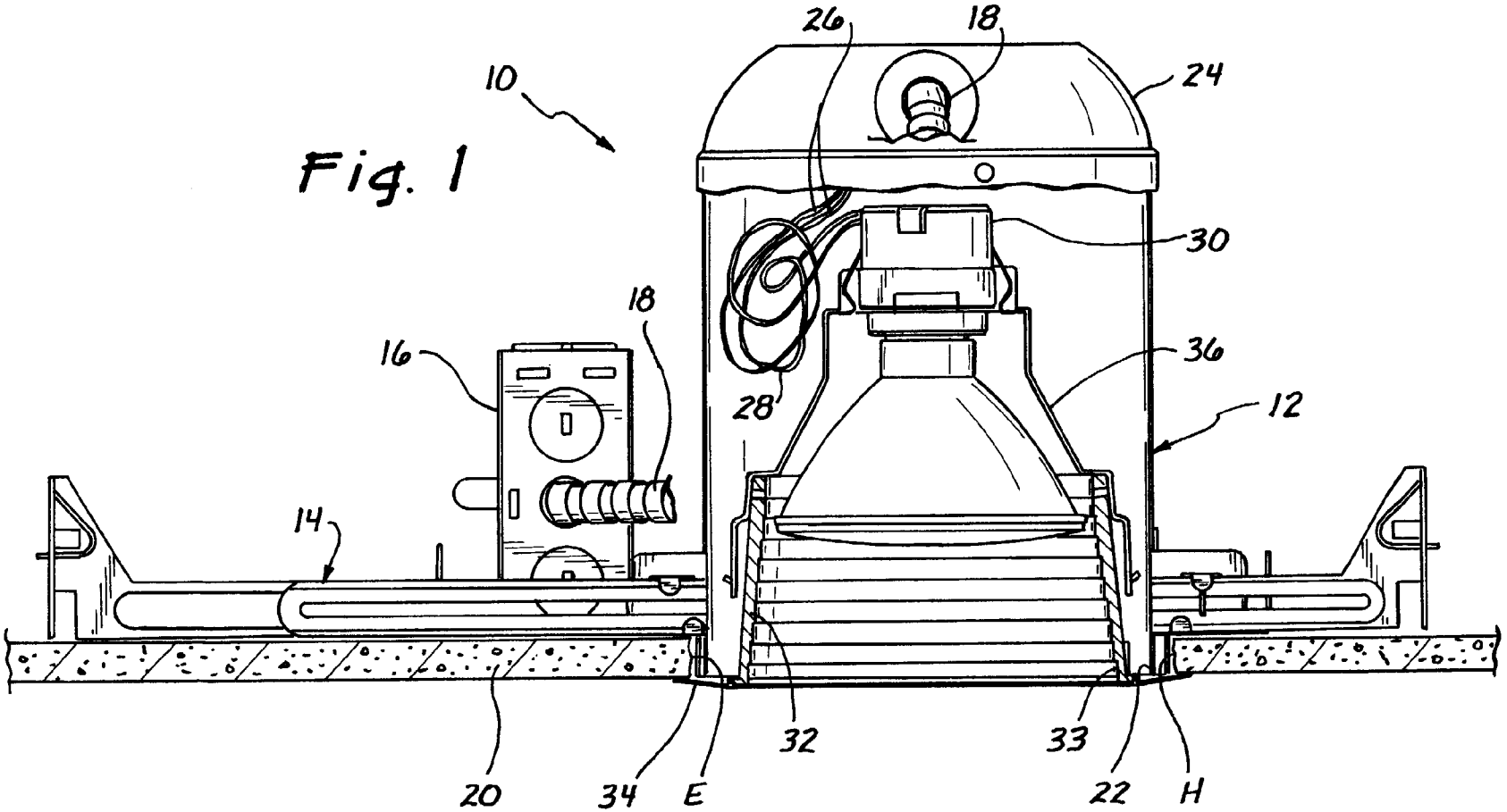
FIG. 1 is a vertical cross-sectional view of a typical recessed in-ceiling light fixture showing a typical trim assembly which includes a light baffle and a trim ring and incorporating the novel universal adapter bracket according to this invention, with a lamp socket supported on the adapter bracket by means of an industry standard spring clip.
Figure 2:
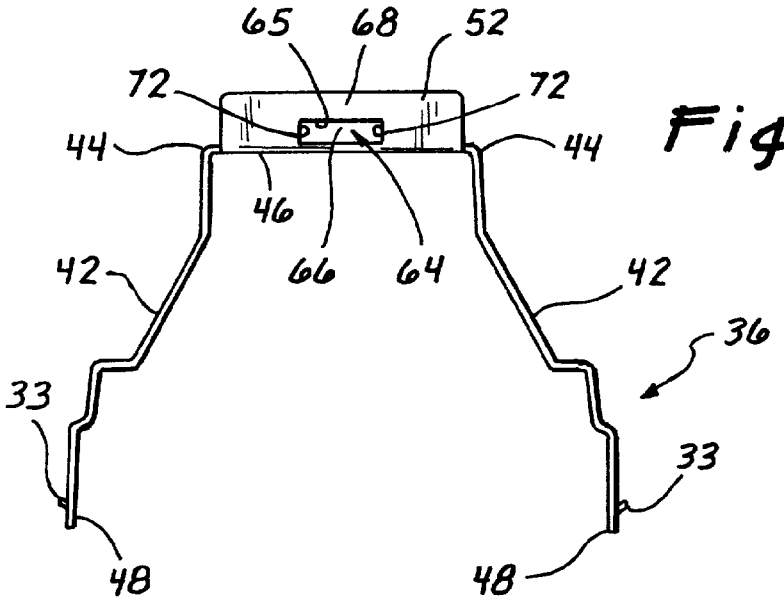
FIG. 2 is a front elevational view of the universal adapter bracket of FIG. 1.
Figure 3:
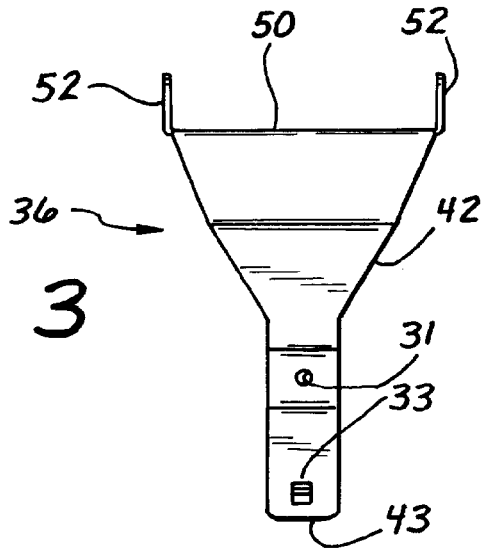
FIG. 3 is a side elevational view of the universal adapter bracket of FIG. 1.

With reference to the accompanying drawings in which like elements are designated by like numerals, FIG. 1 is a vertical cross-sectional view of a typical recessed in-ceiling light fixture, generally designated by numeral 10, and which includes an in-ceiling recessed outer housing 12 supported on a carrier frame 14. Also supported on the carrier frame is an electrical junction box 16 and a flexible electrical conduit 18 between the junction box 16 and the housing 12. The carrier frame 14, housing 12 as well as the junction box 16 and conduit 18 are all conventional components well known in the electrical lighting trade. The carrier frame is sized and configured to fit between ceiling beams or rails so as to support the lower end 22 of lamp housing 12 flush with a ceiling panel 20 hung from the carrier frame 14.

The recessed lamp outer housing 12 is in effect a generally cylindrical can of sheet metal closed at its upper end by a cover 24 which is apertured to admit one end of the electrical conduit 18. The opposite end of conduit 18 is connected to the junction box 16. Insulated electrical wires 26 run from the junction box through conduit 18 and into the lamp housing 12. An excess length of two insulated wires 26 forms a service loop 28 hung loosely inside the housing 12, and the ends of the wires 26 are electrically connected to corresponding screw terminals of a lamp socket 30. The lamp socket is conventional and the screw terminals have been omitted from the drawings for the sake of clarity. The service loop facilitates initial installation and subsequent servicing of the fixture by permitting the lamp socket 30 to hang below the ceiling while attached to the wires.

The bottom 22 of the lamp housing 12 extends through a hole H cut in the ceiling panel 20. This hole typically is rough cut and has an unfinished edge E. In order to give an aesthetically appealing finish to the recessed lamp installation it is customary to include a trim assembly which typically includes a light baffle 32 and a trim ring 34 or other exterior ornament attached to the lower end 33 of the baffle and which is of somewhat greater radius than hole H so as to cover and hide the unfinished edge E. In general, the baffle has a two-fold purpose; an ornamental purpose to conceal the bare sheet metal interior of the housing 12, and a practical purpose in minimizing internal reflections within the housing as well as containing or directing the light output of the fixture to achieve a desired pattern of illumination.

The trim assembly also includes an adapter bracket 36 which serves to support the lamp socket 30 either to the baffle 32 or directly to the trim ring 34 in the case of an open trim fixture.

Figure 5:
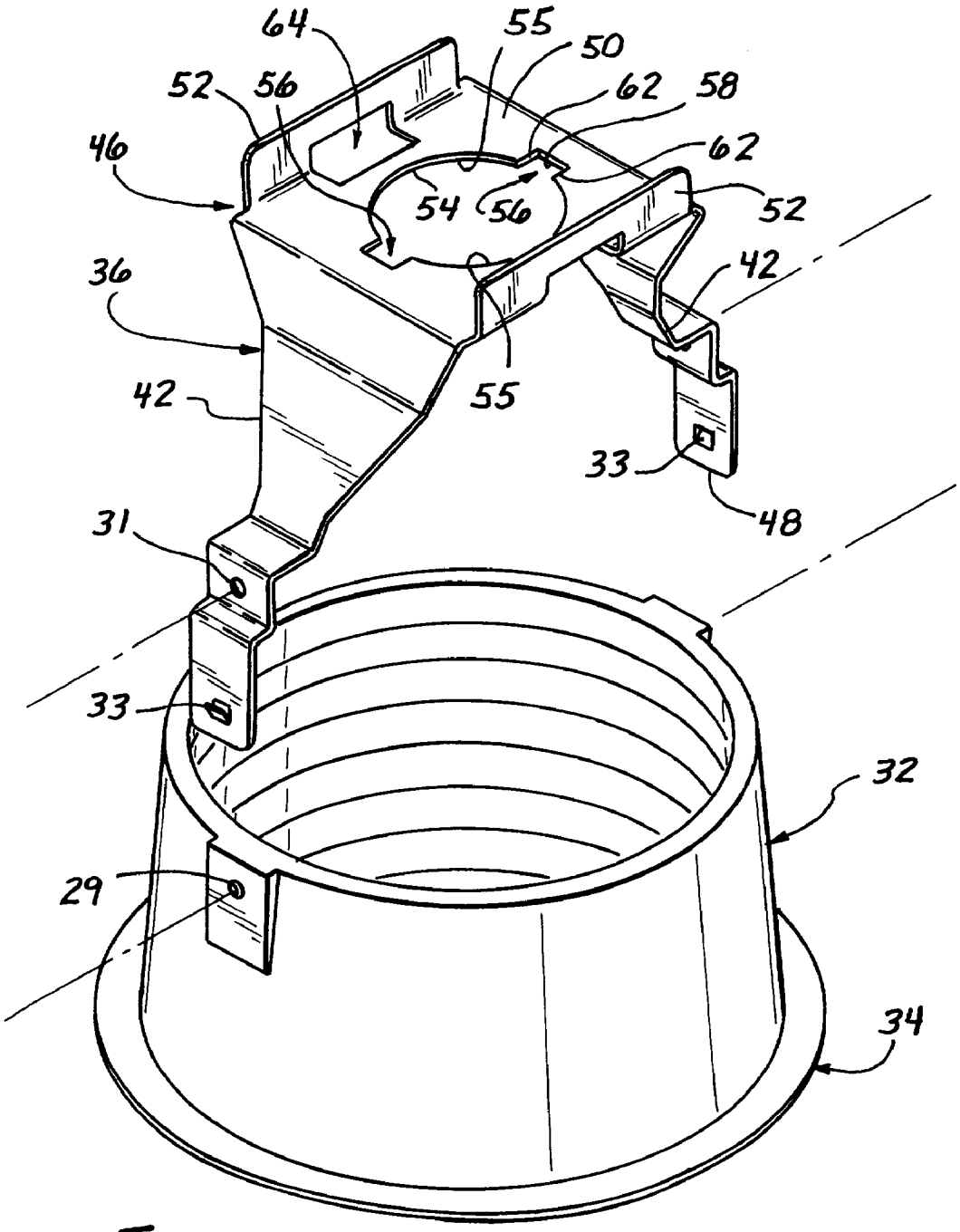
FIG. 5 is an exploded perspective view of the universal adapter bracket and light baffle of the trim assembly of FIG. 1.
Figure 7:
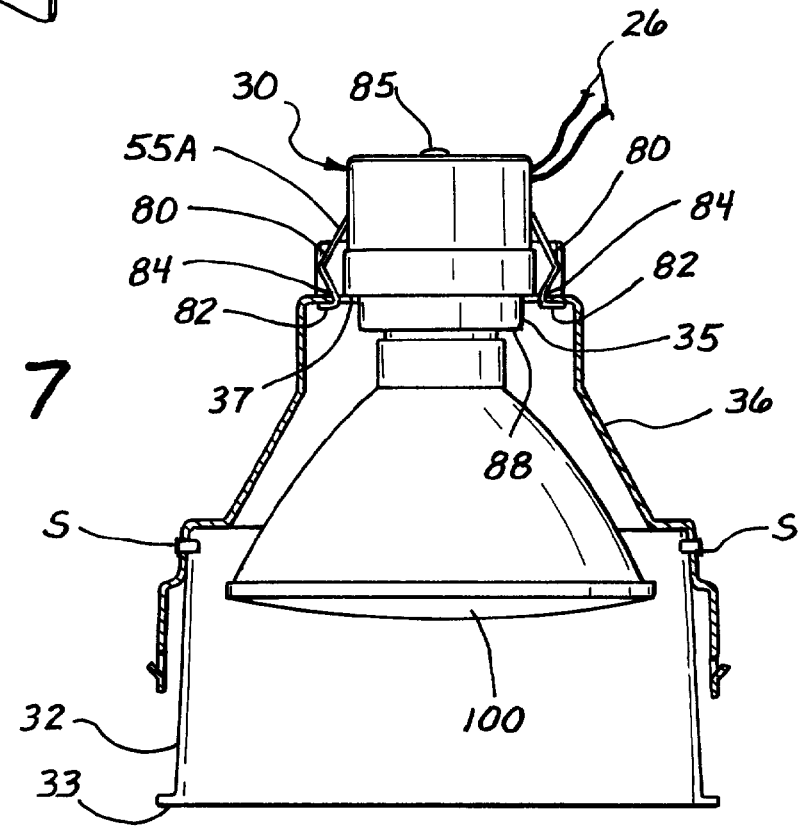
FIG. 7 is a vertical cross-section of the assembly of FIG. 6 taken along lines 6—6 with a reflector type lamp bulb fitted in the lamp socket and the universal adapter bracket assembled to the light baffle.
Figure 10:
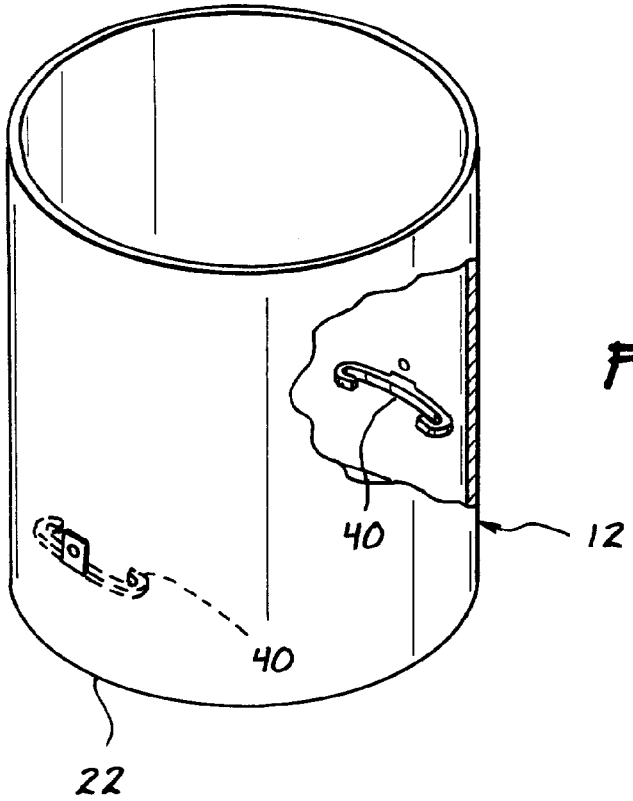
FIG. 10 shows a typical outer housing of an in-ceiling recessed light fixture partially broken away to show one of its trim assembly hanger brackets, the other of its trim assembly hanger brackets being shown in phantom lining.
Figure 11:
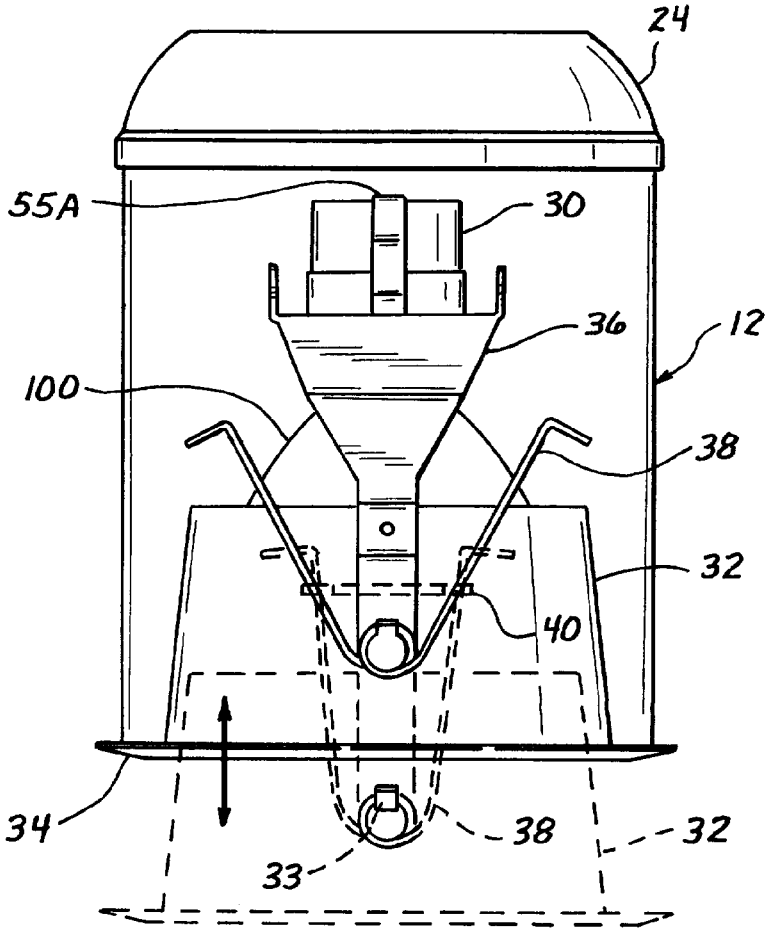
FIG. 11 is a side elevational view which depicts how the complete trim assembly is installed in the outer housing of the light fixture.

The adapter bracket 36 is attached to the baffle 32 by means of fasteners such as two screws S inserted through holes 31 in the bracket 36 and into threaded holes 29 in the baffles, as indicated in FIGS. 5 and 7. In open trim units, the adapter bracket is riveted to diametrically opposite points of the trim ring 34. The trim assembly, with baffle or open trim, is suspended inside the housing 12 by two spring wires 38 attached to opposite sides of the bracket 36 on outwardly bent tabs 33 as best seen in FIG. 11, each spring wire 38 being retained in a corresponding hanger bracket 40 secured at diametrically opposite locations inside the housing 12, as best seen in FIG. 10. FIG. 11 illustrates the installation of the trim assembly in the housing 12. The two spring wires 38 are compressed at their upper ends and each wire is inserted in a corresponding bracket 40. The trim assembly is then pushed up into the housing 12 until the trim ring makes contact with the underside of the ceiling panel. As the trim assembly rises into the housing from the phantom lined position to the solid lined position in FIG. 11, the two free ends of each spring wire 38 spread apart within the respective hanger brackets 40, thereby providing support for the trim assembly. The use of spring wires 38 for retaining the trim assembly in recessed lighting fixtures is conventional and well understood in the trade, and does not require more detailed explanation here.

As was explained in the introductory portion of this disclosure, two different types of lamp socket attachment clips have come into common use in the industry, resulting in incompatibility between trim assemblies designed to accept one or the other clip types. This invention advances over the prior art by providing a universal adapter bracket 36 which is constructed and configured for accepting either one of the two different lamp attachment clips. The universal bracket 36 replaces the conventional lamp socket mounting brackets configured to accept only one type of lamp socket spring clip, and therefore the new adapter bracket 36 permits a new trim assembly to be retrofitted to an existing recessed lamp installation 10 without concern for whether the lamp socket attachment clip on the lamp socket 30 in the existing lamp fixture is of type A or type B.

Figure 6:
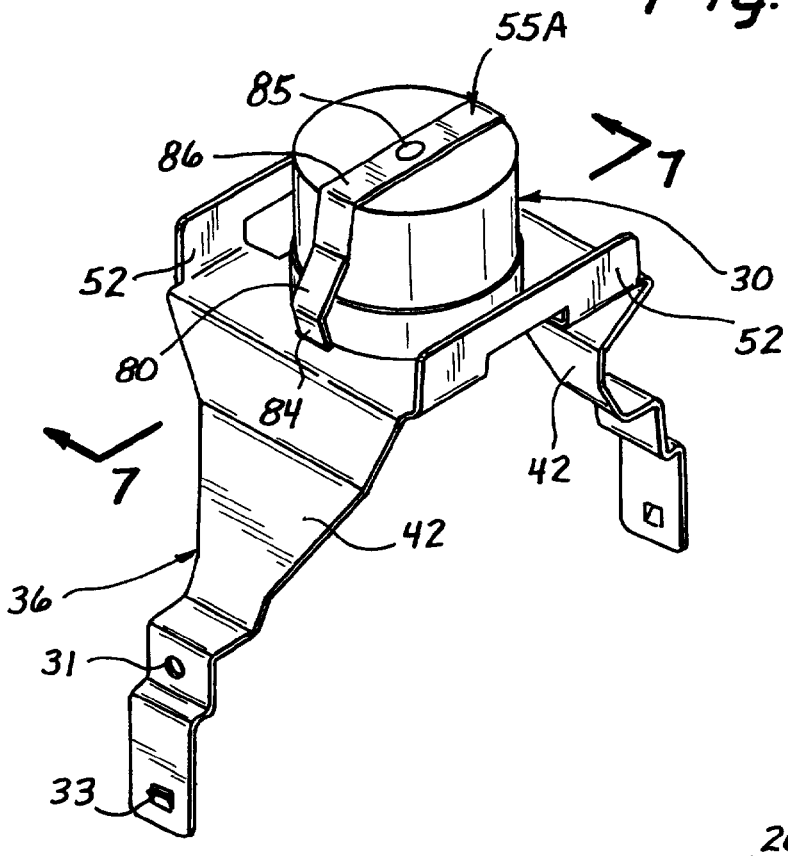
FIG. 6 is a perspective view as in FIG. 6 with a lamp socket secured to the universal adapter bracket by means of a standard spring clip.

The two different types of lamp socket spring clips will be designated for purposes of this explanation as type A clips and type B clips, and identified in the drawings by numerals 55A and 55B, respectively. The lamp socket 30 in FIGS. 6 and 7 is equipped with a type A spring clip 55A, while a type B clip 55B is shown attached to the lamp socket 30 in FIGS. 8 and 9. The type A clip is the previous industry standard clip while the type B clip is the more recently introduced modified clip.

The new universal adapter bracket 36, best seen in FIGS. 2 through 5, has two generally divergent side arms 42 joined at their upper ends 44 by a midportion 46 and having free lower ends 48. The midportion 46 has a generally planar central portion 50 with a longitudinal dimension connecting the two side arms 42 and a transverse dimension perpendicular to the just mentioned longitudinal dimension. The midportion 46 also includes two upright side walls 52 on transversely opposite sides of the central portion 50. The side walls are perpendicular to the central portion 50 and parallel to each other.

As best seen in FIG. 7 the conventional lamp socket 30 has a lower neck 35 of reduced outside circumference which defines a radial shoulder 37. This lower neck 35 fits into a central aperture 54 in the adapter bracket 36. The central portion 50 of the universal bracket 36 has a central aperture 54 sized to closely admit the outside circumference of the lower neck 35 of lamp socket 30 and to make an interference fit with the radial shoulder 37. That is, the lamp socket seats into aperture 54 only up to the shoulder 37 and is secured in that seated position by a lamp socket retaining clip 55A or 55B.

Both A and B type clips have a generally inverted U shape, with a middle 86 which is riveted by rivet 85 to the top of the lamp socket 30 and two spring arms 80 which extend downwardly from opposite sides of the middle 86 and terminate in free arm ends 82. The type A and B clips differ from each other in their overall dimensions, in the width and length of the spring arms as well as the distance or span between the free ends of the spring arms of each clip. Clip A has wider, longer arms and a greater span, whereas Clip B has narrower, shorter arms and a substantially smaller span.

The use of the two different spring clip types with the universal adapter bracket 36 will now be explained with reference to FIGS. 6 through 9. In the following description, like numerals are used to designate similar portions of the two clips.

The use of type A clips will be discussed first, with reference to FIGS. 6 and 7, where clip 55A is shown engaged to the universal bracket 36 with its middle 86 oriented along the longitudinal dimension of the universal bracket 36. The hook shaped free ends 82 of the clip spring arms engage retaining edges defined by two diametrically opposed rectangular cutouts 56, best seen in FIGS. 4 and 5. Each cutout defines a retaining edge 58 between side edges 62. The spacing between the opposite retaining edges 58 is smaller than the natural uncompressed span of the spring arms 80 of clip 55A. The clip is fitted to the bracket 36 by squeezing the arm ends 82 towards each other against the inherent spring force of the clip tending to keep the arm ends apart, until the span between the arm ends is smaller than the distance between the retaining edges 58. The arm ends are then inserted into the cutouts 56 and released, allowing the arm ends to spread apart under inherent spring force of the clip against the retaining edges 58. Each retaining edge 58 is captured in concave portion 84 of the hook shaped end of a corresponding spring arm 80, thereby securing the lamp socket 30 to adapter bracket 36. The open lower end 88 of the lamp socket 30 extends below the midportion 50 for accepting the threaded base of a lamp bulb 100, while the top of the socket is supported above the midportion 50. The circular edge portions 55 of aperture 54 between the cutouts 56 closely contain the socket 30 against lateral movement.

Figure 8:
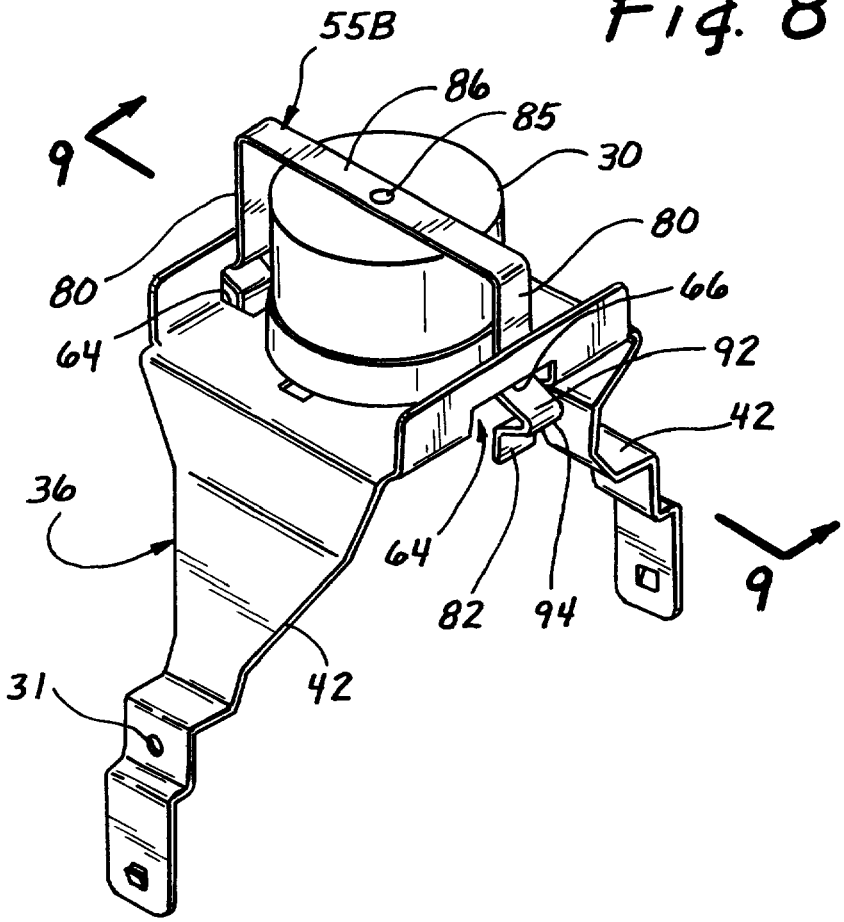
FIG. 8 is a perspective view of a conventional lamp socket secured to the universal adapter bracket by means of a modified spring clip.
Figure 9:
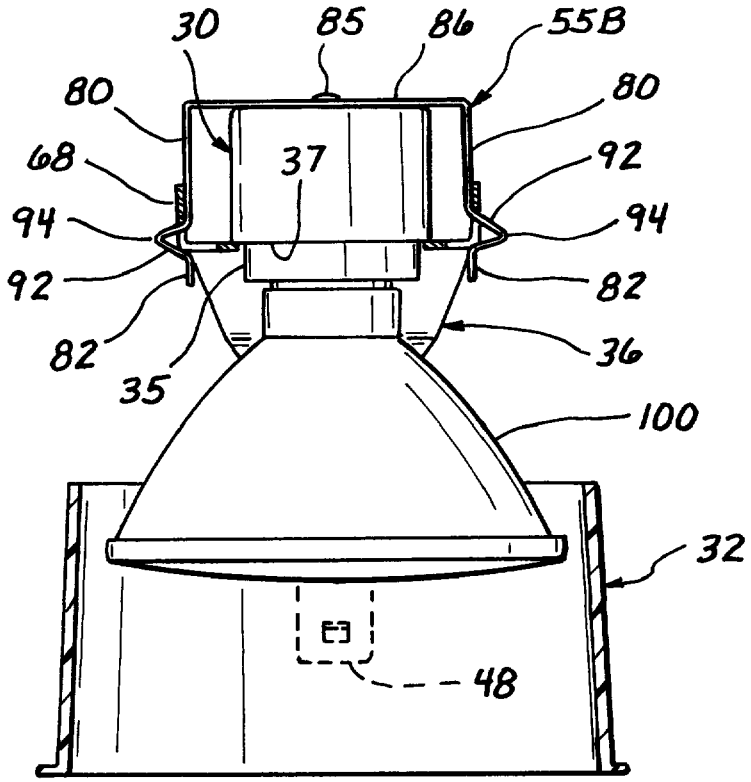
FIG. 9 is a vertical cross-section of the assembly of FIG. 8 taken along lines 9—9 with a reflector-type lamp fitted in the lamp socket and the universal adapter bracket assembled to the light baffle.

Clip 55B is installed on the universal bracket 36 as shown in FIGS. 8 and 9 with the free ends 82 of the spring arms 80 engaged in openings 64 defined in the universal adapter bracket 36 so that clip 55B is supported with its middle 86 in transverse orientation on bracket 36 and at a right angle to the orientation of clip 55A on bracket 36 as described in the preceding paragraph. Each opening 64 is partially defined in the planar central portion 50 and partially in a side wall 52. Thus, each opening 64 includes a side opening 65 and a bottom opening 70. The side opening 65 is closed at its upper end by wall portion 68 and retaining edge 66, and bounded on each side by a vertical edge 72. The lower end of the lateral opening 65 is open to the bottom opening 70 to define opening 64. The spring arms 80 of clip 55B each have a lateral projection 92 in the form of a V shaped crimp, with the point 94 of the V on the two arms pointing away from each other. Clip B is engaged to the universal bracket 36 by squeezing together the free ends of its arms 82 until the spread between the arms is sufficiently reduced to permit the arm ends to be inserted into bottom openings 72 and lowered through the central portion 50 to bring the points of the V shaped crimps 92 into register with the side openings 65 on the side walls 52. The arms 80 of the clip 55B are then released from compression, allowing the arms ends 82 to spread apart and the V crimps 92 to enter the side openings 65 to an engaged condition depicted in FIGS. 8 and 9 where the crimps 92 make an interference fit with retaining edges 66 thereby securing the socket 30 to the adapter bracket 36.

Figure 4:
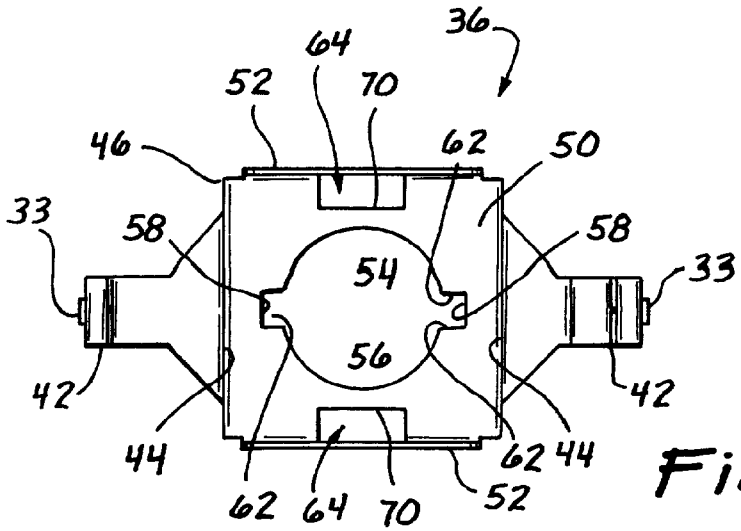
FIG. 4 is a top plan view of the universal adapter bracket of FIG. 1.

As seen in top plan view in FIG. 4, the first retaining portions defined by and including the two diametrically opposed cutouts 56 in lamp socket opening 54 include two opposed spring clip retaining edges 58 which are spaced apart by a first distance on the adapter bracket. The second retaining portions defined by and including openings 64 include spring clip retaining edges 66 diametrically spaced apart relative to lamp socket opening 54 on the adapter bracket by a second distance substantially different from, in this case substantially greater than, the first distance between edges 58, such that lamp socket spring clips of different sizes or different span between the clip arms, such as the different sized clips 55A and 55B, may be engaged to the adapter bracket 36 in one or the other of the first and second retaining portions 56 or 64 diametrically across the lamp socket opening 54, thereby to secure and retain the lamp socket to the adapter bracket.

As shown in FIGS. 8 and 9 clip 55B is oriented with the span of the clip arms transversely to the longitudinal dimension of the universal bracket 36, and thus transverse to the orientation of clip 55A when the latter is engaged to the same universal bracket. The universal bracket can therefore interchangeably accept one clip of either type A or type B, by means of retaining portions provided on the midportion 50 of the bracket as described in preceding paragraphs. It will be appreciated that the engaged positions of the two clips are transverse to each other, clip 55A being aligned with the longitudinal dimension of bracket 36 and clip 55B being aligned with the transverse dimension of the same bracket.

The universal adapter bracket 36 is typically sold as part of a trim assembly which, as already mentioned, includes a baffle 32 and a trim element such as trim ring 34. Both the baffle and the trim element can take many different shapes, styles, materials and finishes, limited only by a designer's creative imagination, and this invention is not limited to any particular trim configuration or design. For example, the baffle and the exterior trim element may be merged into a single unit, partly interior and partly exterior to the housing 12. The exterior trim may take the form of an ornamental assembly such as a series or stack of rings of glass, metal or other materials, held together in any suitable manner such as by metal brackets. The trim assembly may also include various optical elements such as lenses and filters for the purpose of achieving some particular lighting effect. In all cases the universal adapter bracket 36 attaches to the trim assembly, whatever the design or construction of the trim assembly may be, for the purpose of supporting the lamp socket 30, and a lamp bulb 100 fitted to the lamp socket, in a correct operating position relative to the baffle 32 and the housing, and also to support the trim assembly within the housing 12 by means of the spring wires 38, as was explained in connection with FIGS. 10 and 11

While a preferred embodiment of the invention has been explained and illustrated for purposes of clarity and example, it will be understood that many changes, substitutions and modifications to the disclosed embodiment will be apparent to those having only ordinary skill in the art without thereby departing from the scope of the invention defined in the following claims.

What is claimed is:

1. A trim assembly for mounting in the outer housing of in-ceiling recessed light fixtures having a lamp socket supported on either one of different first and second lamp socket spring clips, said trim assembly comprising:

a light baffle and/or a trim ring adapted for insertion in the said outer housing of a recessed light fixture;

an adapter bracket configured to make retentive engagement with said light baffle or said trim ring, said adapter bracket including first portions configured to make retentive engagement with a said first spring clip and second portions configured to make retentive engagement with a said second spring clip;

said first portions including spring clip engaging edges spaced apart by a first distance, said second portions including spring clip engaging edges spaced apart by a second distance substantially different from said first distance, such that lamp socket spring clips of different sizes may be engaged to said adapter bracket in one or the other of said first and second portions;

means for securing said adapter bracket in the said outer housing such that said baffle and/or said trim ring and said socket are supported in said outer housing on said adapter bracket.

2. The trim assembly of claim 1 wherein said adapter bracket has a midportion supported between two arms, each of said arms having a free end retentively engageable to said baffle or said trim ring, and a socket hole in said midportion for inserting a said lamp socket through said adapter bracket, said socket hole being located between the spring clip engaging edges of said first portion and also between the spring clip engaging edges of said second portion, such that a spring clip on a said lamp socket is engageable in either said first portions or said second portions for securing the socket to the adapter bracket.

3. The trim assembly of claim 2 wherein said first portions and said second portions are both defined in said midportion along lines extending diametrically across said socket hole.

4. The trim assembly of claim 2 wherein said first portions are defined by two end cuts each adapted to receive one end of said first lamp bracket, said end cuts being diametrically opposed relative to said socket hole along a first imaginary line joining said two arms of the adapter bracket.

5. The trim assembly of claim 4 wherein said second portions are defined by two openings diametrically opposed relative to said socket hole along a second imaginary line transverse to said first imaginary line.

6. The trim assembly of claim 2 wherein said midportion has a central portion connecting said two arms and two side walls generally transverse to said central portion, said first portions being defined in said central portion and said second portions being defined partly in said central portion and partly in said side walls.

7. The trim assembly of claim 6 wherein said side walls are each joined to said central portion along a corresponding bend line.

8. The trim assembly of claim 7 wherein said adapter bracket comprises a single sheet metal stamping.

9. A trim assembly for in-ceiling recessed light fixtures having a lamp socket supported on either one of different first and second types of lamp socket spring clips, said trim assembly comprising:

a light baffle and/or a trim ring adapted for insertion in the outer housing of a said recessed light fixture; and an adapter bracket having a midportion supported between two arms, each of said arms having a free end retentively engageable to said baffle or said trim ring, and a socket hole in said midportion for inserting a said lamp socket through said adapter bracket; two end cuts in said midportion each adapted to retentively receive one end of a spring clips of the said first type, said end cuts being diametrically opposed relative to said socket hole along a first imaginary line joining said two arms of the adapter bracket; and two side openings diametrically opposed relative to said socket hole along a second imaginary line transverse to said first imaginary line, each said side opening adapted to retentively receive one end of a spring clip of the said second type;

said end cuts being spaced apart by a first distance, said side openings being spaced apart by a second distance substantially different from said first distance, such that the spring clips of the first type and of the second type may be of different sizes and either may be engaged to said adapter bracket for securing a said lamp socket thereto;

whereby the ornamental appearance of an existing in-ceiling lamp fixture can be updated by assembling the existing spring clip of either type to said adapter bracket thereby to secure the said lamp socket in said socket hole, then attaching the adapter bracket and/or trim ring to the baffle and installing the assembled baffle and/or trim ring and adapter bracket in the outer housing of the existing in-ceiling lamp fixture.

10. A trim assembly for installation in the outer housing of an in-ceiling recessed light fixture having a lamp socket supported on either one of different first and second types of lamp socket spring clips, said trim assembly comprising:

a light baffle and/or a trim ring adapted for insertion in the outer housing of the said recessed light fixture; and an adapter bracket retentively engageable to said baffle or said trim ring, said adapter bracket having first and second bracket portions retentively engageable to a spring clip of either said first and second types for securing the said lamp socket to said adapter bracket;

said first and second bracket portions each including spring clip engaging edges spaced apart by substantially different distances, such that lamp socket spring clips of different sizes may be engaged to said adapter bracket in one or the other of said first and second bracket portions;

fasteners for securing said adapter bracket in the said outer housing;

whereby the ornamental appearance of an existing in-ceiling lamp fixture can be updated by assembling the existing lamp bracket of either type to said adapter bracket thereby to secure the said lamp socket in said socket hole, then attaching the adapter bracket to the baffle and/or trim ring and installing the assembled baffle and/or trim ring and adapter bracket in the outer housing of the existing in-ceiling lamp fixture.

11. A method for updating the ornamental appearance of an existing in-ceiling lamp fixture having an installed lamp socket supported on either one of different first and second types of lamp socket spring clips, comprising the steps of:

providing a light baffle and/or a trim ring and an adapter bracket retentively engageable to said baffle or to said trim ring, said adapter bracket having first and second portions respectively retentively engageable to the said spring clips of either the first or second type for securing the said lamp socket to said adapter bracket;

said first portions including spring clip engaging edges spaced apart by a first distance, said second portions including spring clip engaging edges spaced apart by a second distance substantially different from said first distance, such that lamp socket spring clips of different sizes may be engaged to said adapter bracket in one or the other of said first and second portions;

selectively engaging the spring clip on the lamp socket of the existing lamp fixture to one of said first and second portions thereby to secure the lamp socket to said adapter bracket;

retentively engaging said adapter bracket to said baffle; and installing the baffle and/or trim ring in the existing lamp fixture.

12. The method of claim 11 wherein the existing lamp fixture has an outer housing and said step of installing comprises the step of securing said baffle and/or trim ring to the said outer housing of the existing lamp fixture.

13. An adapter bracket for supporting a lamp socket having either one of different first and second type of lamp socket spring clips in a trim assembly of a recessed in-ceiling lamp fixture, the first and second type of lamp socket spring clips having substantially different spring arm spans, said adapter bracket including first portions configured to make retentive engagement with a said first type of spring clip and second portions configured to make retentive engagement with a said second type of spring clip, said first portions and said second portions each being dimensioned to receive the different spring arm span of a corresponding one of the said first and second type of lamp socket spring clips.

14. The adapter bracket of claim 13 wherein said adapter bracket has a midportion supported between two arms, each of said arms having a free end and a socket hole in said midportion for inserting a said lamp socket through said adapter bracket.

15. The trim assembly of claim 14 wherein said first portions and said second portions are both defined in said midportion.

16. The trim assembly of claim 14 wherein said first portions are defined by two end cuts each adapted to receive one end of said first lamp bracket, said end cuts being diametrically opposed relative to said socket hole along a first imaginary line joining said two arms of the adapter bracket.

17. The trim assembly of claim 16 wherein said second portions are defined by two openings diametrically opposed relative to said socket hole along a second imaginary line transverse to said first imaginary line.

18. The trim assembly of claim 14 wherein said midportion has a central portion connecting said two arms and two side walls generally transverse to said central portion, said first portions being defined in said central portion and said second portions being defined partly in said central portion and partly in said side walls.

19. The trim assembly of claim 18 wherein said side walls are each joined to said central portion along a corresponding bend line.

20. The trim assembly of claim 19 wherein said adapter bracket comprises a single sheet metal stamping.

* * * * *